US006043741A

United States Patent [19]

Whitmarsh

[11] Patent Number: 6,043,741

[45] Date of Patent: Mar. 28, 2000

[54] THRESHOLD WARNING SYSTEM FOR WHEELCHAIR LIFTS

[75] Inventor: Sean J. Whitmarsh, Santa Clarita, Calif.

[73] Assignee: Ricon Corporation, Panorama City, Calif.

[21] Appl. No.: 09/079,648

[22] Filed: May 15, 1998

[51] Int. Cl.[7] ..... G08B 21/00

[52] U.S. Cl. ..... 340/540; 340/522; 340/541; 340/556; 340/573.1; 340/686.1

[58] Field of Search ..... 340/540, 522, 340/556, 541, 686.1, 573.1

[56] References Cited

U.S. PATENT DOCUMENTS 4,010,458 3/1977 Kopfli ..... 340/556
5,625,340 4/1997 Gustavsson ..... 340/573.1
5,838,238 11/1998 Abita et al. ..... 340/566
5,933,082 8/1999 Abita et al. ..... 340/540

*Primary Examiner*—Glen Swann
*Attorney, Agent, or Firm*—Thomas I. Rozsa; Tony D. Chen; Jerry Fong

[57] ABSTRACT

A threshold warning system is installed directly on a conventional lift to fully comply with the SAE standard No. J2093. The threshold warning system comprises a sensor device for sensing whether there is an object crossing the boundary of the threshold zone, and a platform position indication device for determining whether the platform is in an unsafe position. The threshold warning system comprises an audible and/or visual warning device for warning a wheelchair user or a passenger when the user or passenger moves into a threshold zone from the vehicle opening while the platform is in an unsafe level for exiting from or boarding into the vehicle.

34 Claims, 5 Drawing Sheets

FIG.2
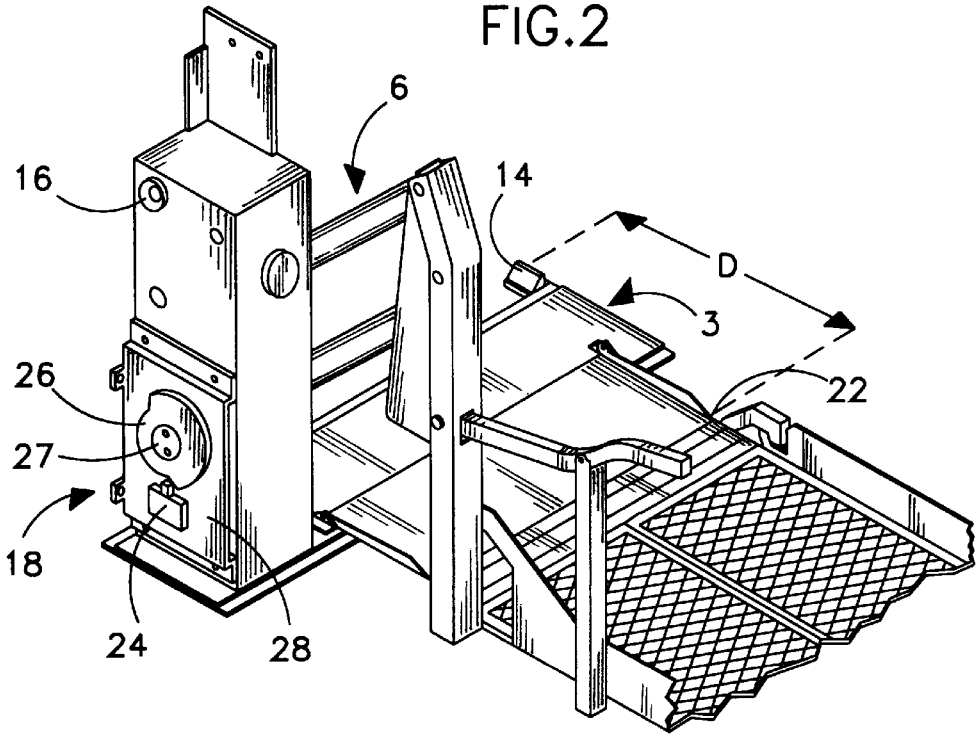
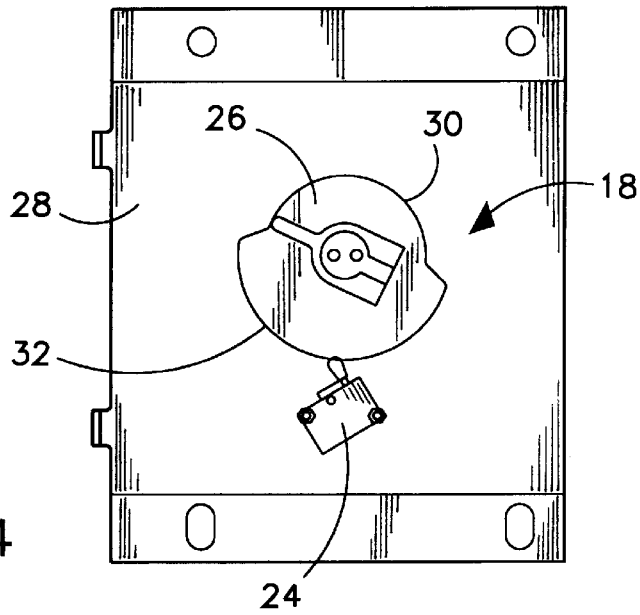
FIG.4

THRESHOLD WARNING SYSTEM FOR WHEELCHAIR LIFTS

BACKGROUND OF THE INVENTION

Field of the Invention

The present invention generally relates to the field of warning systems. More particularly, the present invention relates to the field of audible and/or visual warning systems for use in vehicular lifts.

Description of the Prior Art

Specifically, safety is always the most important concern in the use of wheelchair lifts. Many improvements have been accomplished in the past years in designing and manufacturing different types of wheelchair lifts. Related standards for wheelchair lifts are established by, for example, Society of Automotive Engineers (SAE) to provide industrial standards to monitor and test wheelchair lifts. All wheelchair lift manufacturers must enforce and follow related industrial standards to ensure the products delivered are safe and reliable.

In SAE standard No. J2093, there is a threshold warning requirement for wheelchair lifts. Specifically, the standard states that each wheelchair lift shall include a threshold warning system to give an audible and/or visual warning to a wheelchair passenger approaching the lift to a vehicle floor level that the lift platform is more than one (1) inch below the vehicle floor level and the warning system sensor shall cover an access area not less than eighteen (18) inches away from a threshold.

It is desirable to provide a threshold warning system which meets the SAE standard No. J2093 mentioned above.

SUMMARY OF THE INVENTION

The present invention is a threshold warning system for use with a conventional vehicular lift. The present invention threshold warning system is installed directly on the vehicular lift to fully comply with the SAE standard No. J2093. The threshold warning system comprises an audible and/or visual warning device for warning a user or a passenger that the user or passenger has entered a threshold zone while the platform is below the vehicle floor level. The threshold warning system further comprises a sensor device for sensing whether an object has crossed a pre-defined distance from an opening of the vehicle. The object can be anything, such as a person (a user or passenger) or a wheelchair, or anything that would indicate that it is too close to the threshold while the platform is in an unsafe position. The threshold is the outer most edge of the floor within the vehicle opening. The sensor device can cover the access area with a variety of distance ranges away from the threshold which creates the possibility of an even higher level of protection, exceeding the SAE standard.

It is one object of the present invention to provide a threshold warning system which is in full compliance with the SAE standard No. J2093.

It is another object of the present invention to provide a threshold warning system on a vehicular lift as a safety means for any edge unprotected with a physical barrier on a vehicle opening.

Further novel features and other objects of the present invention will become apparent from the following detailed description, discussion and the appended claims, taken in conjunction with the drawings.

BRIEF DESCRIPTION OF THE DRAWINGS

The following figures are for the purpose of demonstrating a specific application and are not intended to limit the scope of the invention.

FIG. 2 is a front isometric view of the wheelchair lift shown in FIG. 1, showing a cam assembly of the present invention threshold warning system at a position relative to the platform position;

FIG. 4 is a plan view of the cam assembly of the present invention threshold warning system;

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
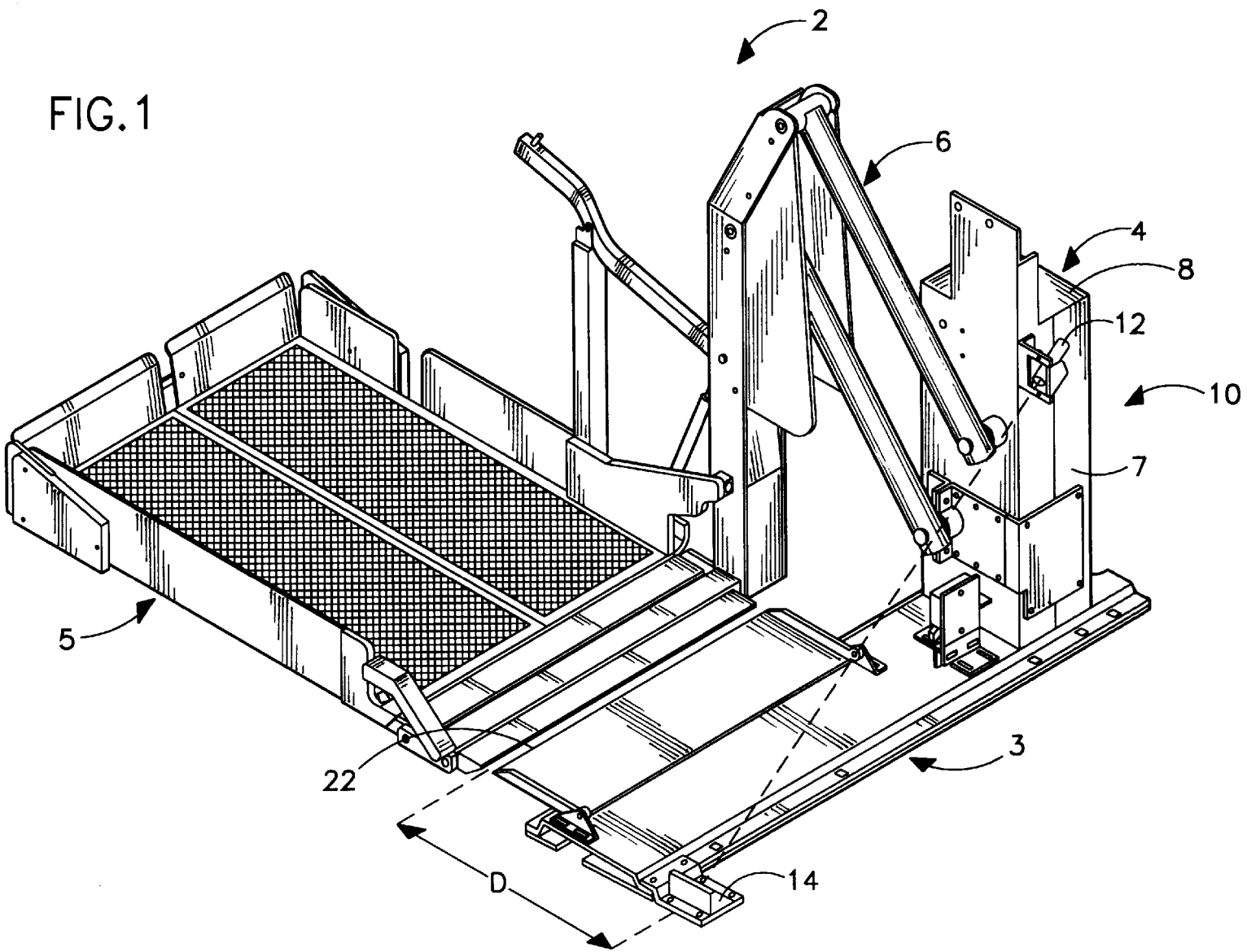
FIG. 1 is an enlarged rear isometric view of a vehicular wheelchair lift when it is in an entry level position, showing the present invention threshold warning system.
Figure 3:
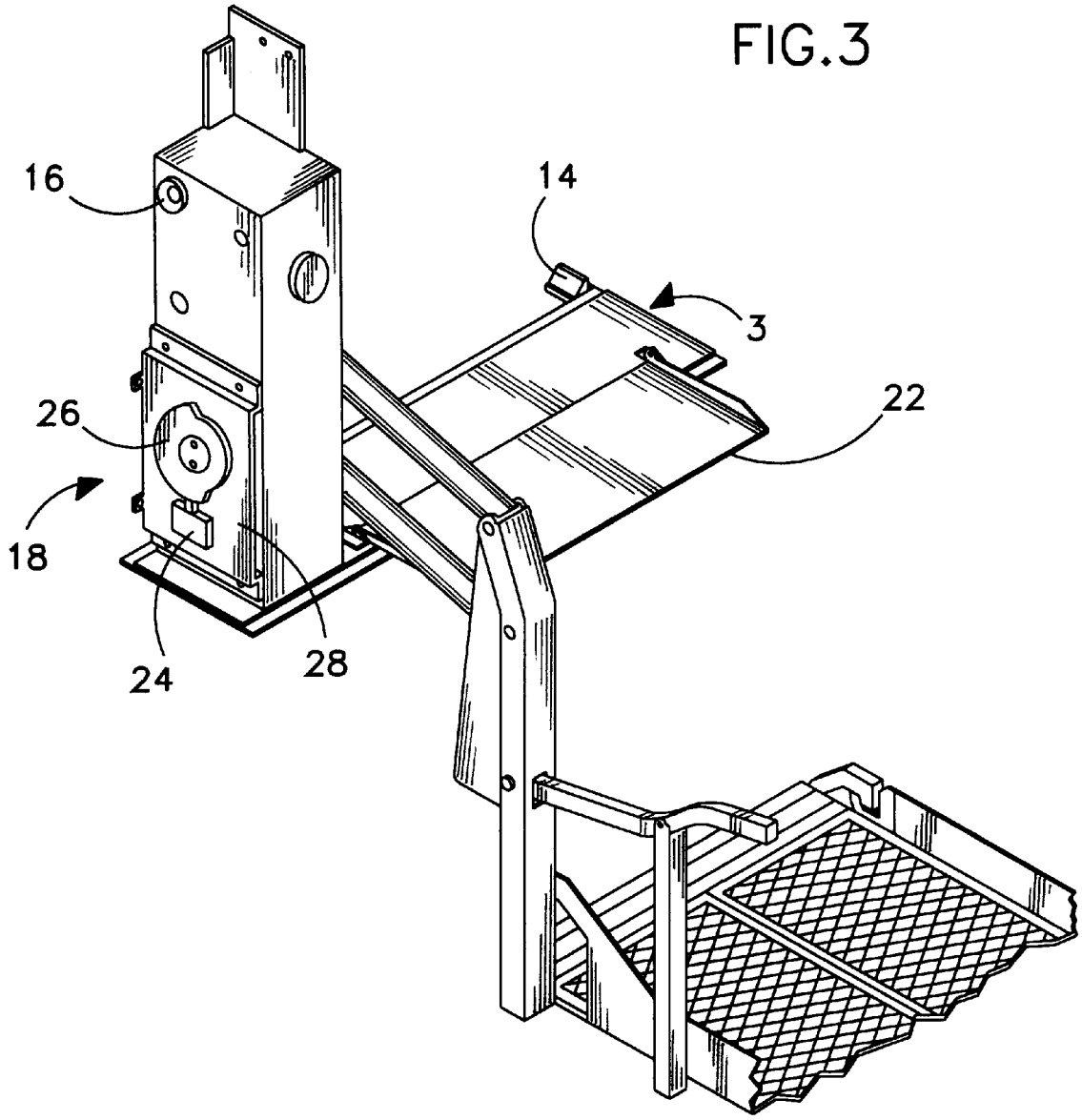
FIG. 3 is a front isometric view of the wheelchair lift when it is in a ground level position, showing the cam assembly of the present invention threshold warning system at a position relative to the platform position.

Referring now to FIGS. 1, 2 and 3, there are shown isometric views of a conventional lift 2 such as a wheelchair lift with the present invention threshold warning system 10 installed thereto. For demonstration purposes, a wheelchair lift is presented. The wheelchair lift 2 is installed within a vehicle (not shown) which has an opening such as a side or rear door opening (not shown) and a floor (not shown). The wheelchair lift 2 basically includes a mounting assembly 3, an actuating system such as a hydraulic actuating system 4, a platform assembly 5, a linking assembly 6, and the present invention threshold warning system 10. It noted that while a hydraulic actuating system is illustrated in the drawings and described herein below, the present invention can be used in conjunction with any type of actuating systems, either a manual actuating system or a power actuating system (electrical or hydraulic or otherwise).

Since the lift 2 is conventional in the art, the description thereof will only be described in general terms. The mounting assembly 3 is conventionally mounted on the vehicle floor adjacent to the vehicle door opening. The hydraulic actuating system 4 comprises at least one single hydraulic cylinder (not shown) which is installed within a tower housing 7 affixed on the mounting assembly 3. The linking assembly 6 is connecting the hydraulic actuating system 4 through the housing 7 and the platform assembly 5 for manually or automatically moving the platform assembly 5 from a stow position inside the vehicle to an entry level position at the vehicle door opening and inversely, and moving the platform assembly 5 between the entry level position and a ground level position outside the vehicle and inversely, or only moving the platform between the entry and the ground level positions.

The present invention threshold warning system 10 is used in conjunction with the lift 2 for notifying a passenger in a wheelchair that the position of the platform assembly 5 is at an unsafe level for exiting from or boarding into the vehicle. The warning system 10 warns a user in the wheelchair lift that the platform assembly 5 is not at a safe level for boarding. The criteria used to determine this unsafe condition is as follows: (a) the platform assembly 5 is lower that the acceptable boarding level; and (b) an object moves into a threshold zone either from inside of the vehicle or moves from the platform into the vehicle, where the lift 2 is installed. Both conditions must be met for the system to warn the user.

It should be pointed out that the warning system may be used to provide a warning signal when an object moves into the platform from the inside of the vehicle or moves to the vehicle from the platform. The illustrations in the drawings and the following description only demonstrate one situation in which the warning system warns a user in a wheelchair that the platform assembly 5 is not at a safe level for exiting the vehicle, but the present invention is applicable to both situations.

Figure 5:
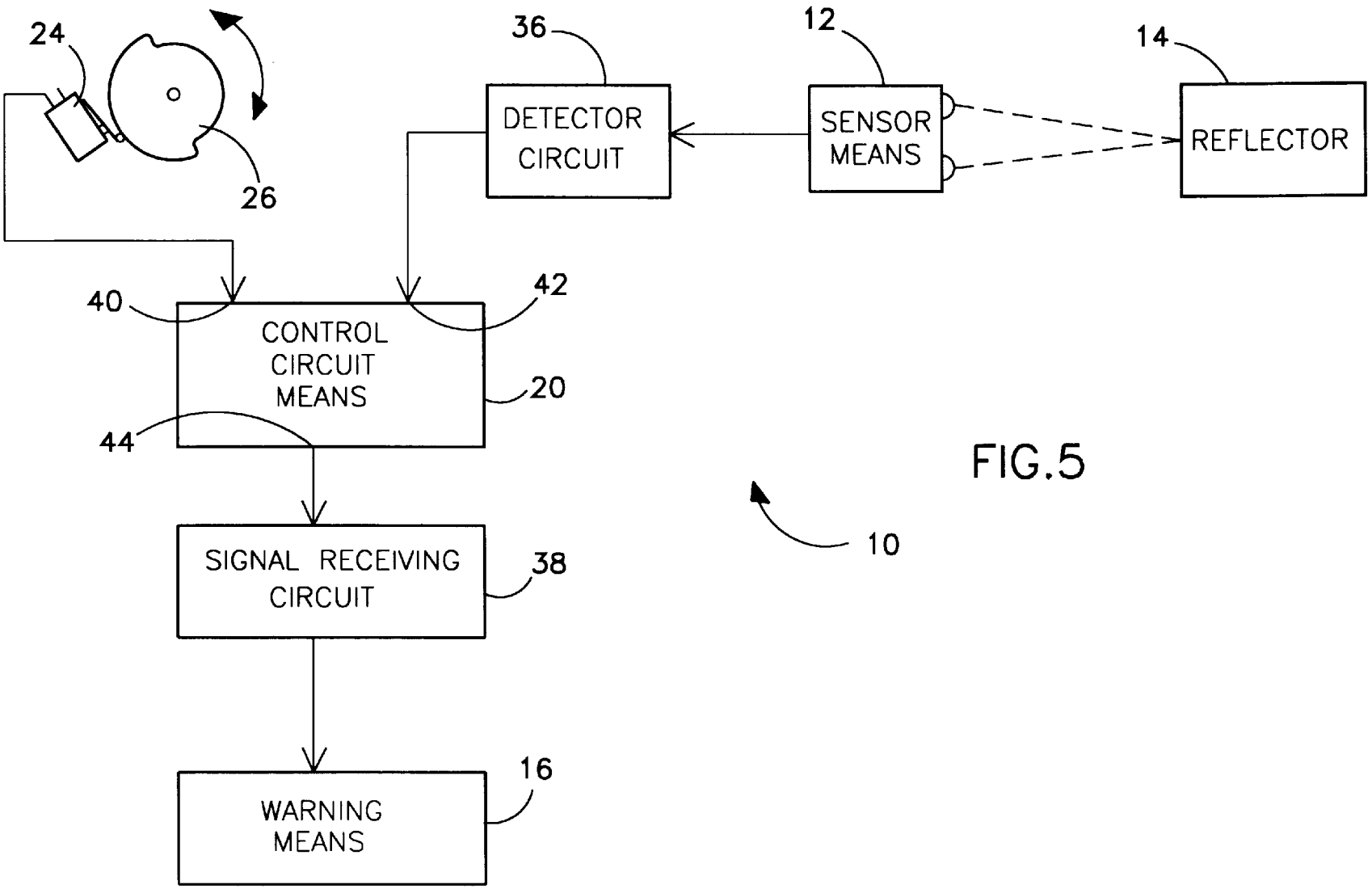
FIG. 5 is a block diagram of the present invention threshold warning system.

The warning system 10 comprises a sensor means 12, a reflector means 14, a warning means 16, a cam assembly 18, and a control circuit means 20 (FIG. 5). The sensor means 12 is adjustably mounted adjacent to an upper end 8 of the housing 7 for emitting an infrared beam (shown as dashed lines) directly across the vehicle door opening to the reflector means 14 which is remotely mounted adjacent to the mounting assembly 3. The reflector means 14 reflects the infrared beam which bounces back to the sensor means 12 if the infrared beam is uninterrupted (unbroken). To make the sensor means 12 less sensitive to ambient light, the beam is modulated. As one example, the beam is modulated by way of pulsing at 3 kHz. If the beam is interrupted (broken), the sensor means 12 generates and transmits an output signal to the control means 20 to inform the control means 20 that the beam is interrupted. The sensor means 12 senses a threshold zone 23 adjacent to the vehicle opening to determine if an object is entering into the threshold zone 23, which is an area within a depth "D" of a pre-defined distance such as eighteen inches (18") from the threshold 22. The object can be anything, but the goal is to sense a person (a user of a wheelchair or simply a passenger), a wheelchair, or anything else that it is too close to the threshold zone 23 while the platform assembly 5 is at an unsafe position. The sensor means 12 can cover the access area (D) with a variety of pre-defined distance ranges away from the threshold 22 which creates even a higher level of protection.

It will be appreciated that the sensor means can be a passive infrared device (motion sensor), a radar device reflection (HF radio waves) or an ultrasonic device reflection (ultrasonic sounds), sensitive mat, sensitive trip and sensitive bladder, which are also within the spirit and scope of the present invention.

FIG. 4 shows a plan view of the cam assembly 18. Referring to FIGS. 2, 3 and 4, the cam assembly 18 is used for determining the position of the platform assembly 5. The cam assembly 18 comprises a limit switch 24 and a cam wheel 26. Both the limit switch 24 and the cam wheel 26 are mounted on a mounting plate 28 which is mounted on the housing 7. The cam wheel 26 moves together with the linkage axle 27 and has a lower perimeter region 30 and a higher perimeter region 32 such that when the higher perimeter region 32 engages with the limit switch 24, thereby activating the limit switch 24 is generated an output signal to control means 20 to inform the control means 20 that the platform assembly 5 is in an unsafe level for exiting from the vehicle. The cam wheel 26, is rotates relative to the limit switch 24 and in synchronism with the movement of the platform assembly 5. For example, between the ground level and unsafe boarding level, the cam wheel 26 will actuate the limit switch 24 (see FIG. 3), and at the safe boarding level the cam wheel 26 will release the limit switch 24 (see FIG. 2). Obviously this arrangement may be reversed. Alternatively, the arrangement of the high and low perimeter regions on the cam wheel may be reversed. In addition, instead of actuating the limit switch when the lift is unsafe to use and generating an output signal, the cam wheel may actuating the limit switch when the lift is in a safe position. It is the change of the states or condition of the limit switch when the platform position changes from safe to unsafe or from unsafe to safe that informs the control means that the platform is unsafe or unsafe for use which in turn cause a warning signal to be generated.

The warning means 16 is mounted on the housing 7 adjacent to the upper end 8. The warning means 16 can be an audio warning device or a visual warning device. The warning means 16 is electrically coupled to the control means 20 such that when the warning means 16 receives an unsafe output signal from the control means 20, and thereby activates the warning means 16 that the platform assembly 5 is in the unsafe level for exiting from or boarding into the vehicle.

Referring to FIG. 5, there is shown a block diagram of the present invention threshold warning system 10. The limit switch 24 of the cam assembly 18 is electrically coupled to a first input 40 of the control circuit means 20, whereby the limit switch 24 transmits an output signal to the control circuit means 20. The sensor means 12 is electrically coupled to a detector circuit 36 which is designed so that it is only sensitive to the modulated beam. The detector circuit 36 is electrically coupled to a second input 42 of the control circuit means 20 and transmits an output signal to the control circuit means 20. The control circuit means 20 processes the two output signals and generates an unsafe output signal to a signal receiving circuit 38 which in turn triggers the warning means 16 to alert the user that the platform assembly 5 is in an unsafe level for exiting from or boarding into the vehicle.

It will be appreciated that the circuits mentioned above are conventional in the art. For example, the circuits can be designed with a micro-controller device which can be programmed to perform a specific function, conditional logic, discrete analog device, or relay logic, etc.

Figure 6:
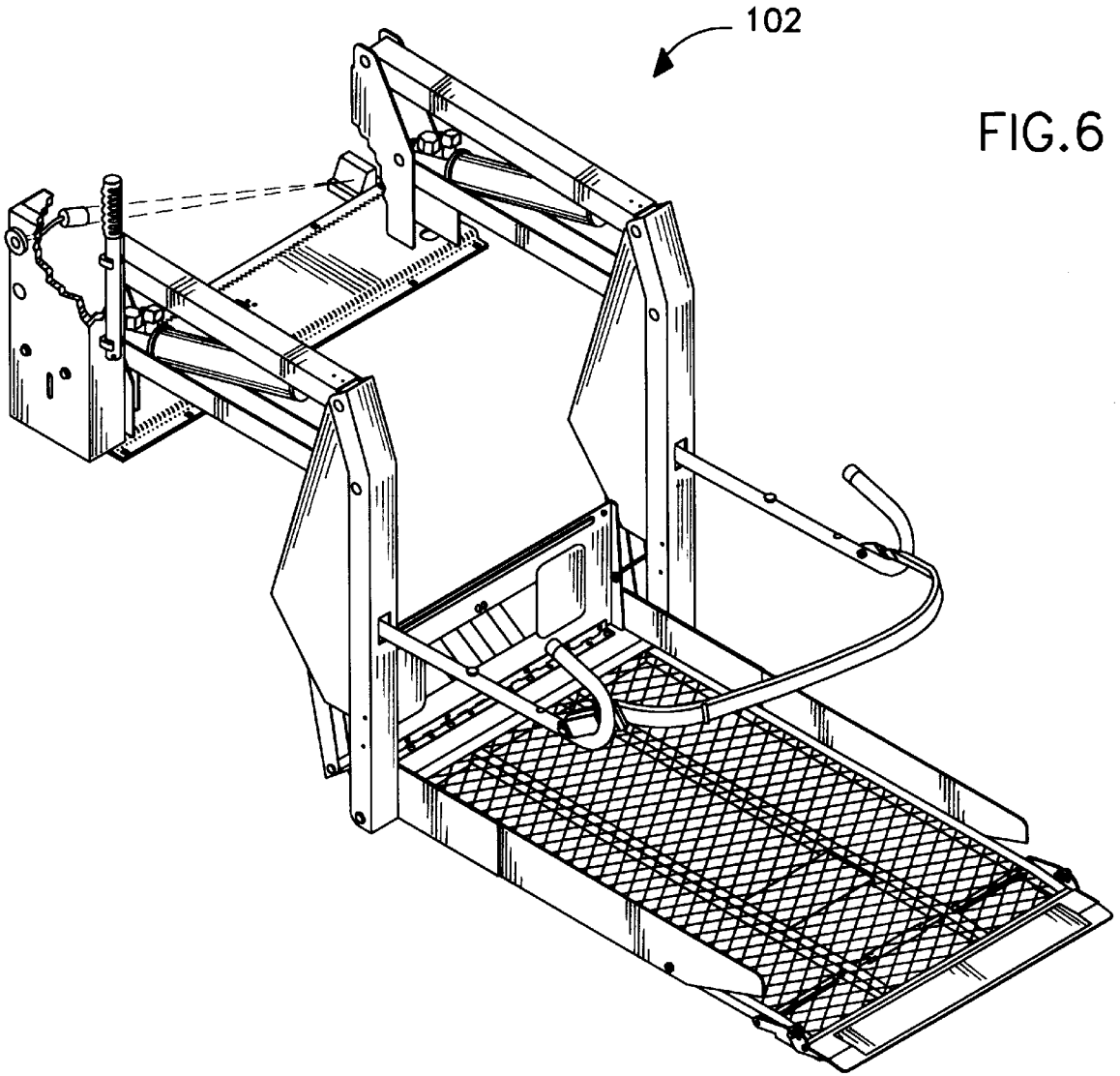
FIG. 6 is a front isometric view of another vehicular wheelchair lift when it is in a ground level position, showing the present invention threshold warning system installed thereto.

Referring to FIG. 6, there is shown an isometric view of another type of wheelchair lift 102 which can be utilized with the present invention threshold warning system. It will be appreciated that the present invention threshold warning system can be incorporated with any type of wheelchair lift, person lift, or any device installed at the elevated threshold of a doorway, wherein the movement of the device creates an unsafe condition and a physical barrier cannot be incorporated.

Defined in detail, the present invention is a wheelchair lift for use in conjunction with a vehicle having an opening and a floor, the wheelchair lift comprising: (a) a mounting assembly mounted on the vehicle floor adjacent to the vehicle opening; (b) an actuating system which is affixed to the mounting assembly and including at least one actuating means; (c) a platform assembly; (d) a linking assembly connecting to the actuating system and the platform assembly for moving the platform assembly between an entry level position and a ground level position outside the vehicle and inversely; (e) a warning system for providing warning when an object moves into a threshold zone while the platform assembly is in an unsafe level, the warning system including a sensor means, a reflector means, a warning means, a platform position indication means, and a control means. The sensor means arranged for emitting an infrared beam directly across the vehicle opening to the reflector means which is mounted remotely from the sensor means, where the reflector means reflects the infrared beam back to the sensor means such that the infrared beam is uninterrupted for sensing if an object moves into a threshold zone adjacent to the vehicle opening. The platform position indication means arranged for determining the position of the platform assembly and comprising a cam wheel which is located relative to a limit switch and rotates with the movement of the platform assembly, wherein the cam wheel changes the condition of the limit switch when the platform assembly is in an unsafe level. The control means having a first input coupled to the platform position indication means for receiving a platform signal, a second input coupled to the sensor means for receiving a threshold signal, and an output for transmitting an output signal based on the conditions of the platform signal and the threshold signal. The warning means coupled to the output of the control means for receiving the output signal from the control means which in turn activates the warning means to indicate that an object moves into the threshold zone while the platform assembly is in the unsafe level. The threshold warning system of the wheelchair lift provides warning when an object moves into the threshold zone while the platform assembly is in the unsafe level.

Defined broadly, the present invention is a threshold warning system for a lift which is used in conjunction with a vehicle having an opening and a floor, the lift including a mounting assembly being mounted on the vehicle floor adjacent to the vehicle opening, an actuating system mounted on the mounting assembly, a platform assembly, and a linking assembly connecting to the actuating system and the platform assembly for moving the platform assembly between an entry level position and a ground level position outside the vehicle and inversely, the threshold warning system comprising: (a) a sensor means for emitting an infrared beam directly across the vehicle opening for sensing a threshold zone adjacent to the vehicle opening when an object moves into the threshold zone; (b) a reflector means for mounting adjacent to the mounting assembly and remotely located from the sensor means, where the reflector means reflects the infrared beam back to the sensor means such that the infrared beam is uninterrupted; (c) a cam assembly for determining the position of the platform assembly which switches a limit switch when the platform is in a unsafe level; (d) a control means having a first input coupled to the limit switch for determining the condition of the limit switch, a second input coupled to the sensor means for determining the condition of the sensor means, and an output for transmitting an output signal based on the conditions of the limit switch and the sensor means; (e) a warning means coupled to the output of the control means for receiving the unsafe output signal from the control means which in turn activates the warning means to indicate that the platform assembly is in the unsafe level and an object moves into the threshold zone; (f) whereby the threshold warning system provides warning when an object moves into the threshold zone while the platform assembly is in the unsafe level.

Defined more broadly, the present invention is a warning system for a lift which is used in conjunction with a vehicle having an opening and a floor, the lift including a platform, the warning system comprising: (a) means for sensing a threshold zone adjacent to the vehicle opening and transmitting a threshold output signal when an object moves into the threshold zone; (b) means for determining the position of the platform and transmitting a position output signal; and (c) means for generating a warning signal based on the conditions of the threshold output signal and the position output signal; (d) whereby the warning system provides warning when an object moves into the threshold zone while the platform is in the unsafe level.

Of course the present invention is not intended to be restricted to any particular form or arrangement, or any specific embodiment disclosed herein, or any specific use, since the same may be modified in various particulars or relations without departing from the spirit or scope of the claimed invention herein above shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A warning system for a lift which is used in conjunction with a vehicle having an openng and a floor, the lift including a platform, the warning comprising:

a. means for sensing a threshold zone adjacent to said vehicle opening and transmitting a threshold output sinnal when an object moves into the threshold zone;

b. means for dertermining the position of said platform and transmitting a position output signal; and c. means for generating a warning signal based on the conditions of said threshold ouput signal and said position output signal;

d. whereby said warning system provides warning when an object moves into said threshold zone while said platform is at an unsafe level.

2. The warning system in accordance with claim 1 wherein said sensing means includes a sensor and a refletor, wherein the sensor emits an infrared beam to the reflector.

3. The warning system in accordance with claim 2 wherein said infrared beam is modulated for the purposes of distinguishing the beam from ambient light.

4. The warning system in accordance with claim 1 wherein said sensing means comprises a passive infrared device.

5. The warning system in accordance with claim 4 wherein said passive infrared device comprises a motion sensor.

6. The system in accordance with claim 1 wherein said sensing means comprises a radar reflection device operating by HF radio waves.

7. The warning system in accordance with claim 1 wherein said sensing means comprises an ultrasonic reflection device operating by ultrasonic sounds.

8. The warning system in accordance with claim 1 wherein said sensing means comprises a pressure sensitive mat.

9. The warning system in accordance with claim 1 wherein said sensing means comprises a pressure sensitive strip.

10. The warning system in accordance with claim 1 wherein said sensing means comprises a pressure sensitive bladder.

11. The warning system in accordance with claim 1 wherein the condition of said threshold output signal transmitted by said sensing means changes when said sensing means senses an object crossing a boundary of said threshold zone.

12. The warning system in accordance with claim 1 wherein said means for determining the position of said platform and transmitting said position output signal when said platform is at said unsafe level comprises a cam assembly including a limit switch and a cam wheel.

13. The warning system in accordance with claim 1 wherein said means for determining the position of said platform and transmitting a position output signal stops transmitting said position output signal when said platform is at a safe level.

14. The warning system in accordance with claim 1 wherein the condition of said platform output signal transmitted by said means for determining the position of said platform changes when the position of said platform changes between an unsafe level and a safe level.

15. The warning system in accordance with claim 1 wherein said warning means is an audio warning device.

16. The warning system in accordance with claim 1 wherein said warning means is a visual warning device.

17. The warning system in accordance with claim 1 wherein said unsafe level is a platform position which is lower than an entry level position at said vehicle opening.

18. The warning system in accordance with claim 1 wherein said threshold zone has a depth of a pre-defined safe distance.

19. The warning system in accordance with claim 18 wherein said pre-defined safe distance is not less than eighteen (18) inches.

20. A threshold waning system for a lift which is used in conjunction with a vehicle having an opening and a floor, the lift including a mounting assembly being mounted on the vehicle floor adjacent to the vehicle opening, an actuating system mounted on the mounting assembly, a platform assembly, and a linking assembly connecting to the actuating system and the platform assembly for moving the platform assembly between an entry level position and a ground level position outside the vehicle and inversely, the threshold warning system comprising:

a. a sensor means for emitting an infrared beam directly across said vehicle opening for sensing a threshold zone adjacent to said vehicle opening when an object moves into the threshold zone;

b. a reflector means for mounting adjacent to said mounting assembly and remotely located from said sensor means, whereby said reflector means reflect said infrared beam back to said sensor means when said infrared beam is uninterrupted;

c. a cam assembly for monitoring the position of said platform assembly which switches a limit switch when said platform in at an unsafe level;

d. a control means having a first input coupled to said limit switch for detecting the condition of said limit switch, a second input coupled to said sensor means for detecting the condition of said sensor means, and an output for transmitting an unsafe output signal based on the conditions of said limit switch and said sensor means; and e. a warning means coupled to said output of said control means for receiving said unsafe output signal from said control means which in turn activates the warning means to indicate that said platform assembly is at said unsafe level and an object moves into said threshold zone;

f. whereby said threshold warning system provides warning when an object moves into said threshold zone while said platform assembly is at said unsafe level.

21. The threshold warning system in accordance with claim 20 wherein said infrared beam is modulated for the purpose of distinguishing the beam form ambient light.

22. The threshold warning system in accordance with claim 20 wherein said cam assembly comprises a cam wheel which rotates relative to said limit switch and in synchronism with the movement of said platform assembly.

23. The threshold warning system in accordance with claim 20 wherein said warning means is an audio warning device.

24. The threshold warning system in accordance with claim 20 wherein said warning means is an audio warning device.

25. The threshold warning system in accordance with claim 20 wherein said unsafe level is a platform position which is lower than an entry level position at said vehicle opening.

26. The warning system in accordance with claim 20 wherein said threshold zone has a depth of a pre-defined safe distance.

27. The warning system in accordance with claim 26 wherein said pre-defined safe distance in not less than eighteen (18) inches.

28. A wheelchair lift for use in conjunction with a vehicle having an opening and a floor, the wheelchair lift comprising:

a. a mounting assembly mounted on said vehicle floor adjacent to said vehicle opening;

b. an actuating system which is affixed to said mounting assembly and including at least one actuating means;

c. a platform assembly;

d. a linking assembly connecting to said actuating system and said platform assembly for moving said platform assembly between an entry level position and a ground level position outside said vehicle and inversely;

e. a warning system for providing warning when an object moves into a threshold zone while said platform assembly is at an unsafe level, the warning system including a sensor means, a reflector means, a warning means, a platform position monitoring means, and a control means:

(i) said sensor means arranged for emitting an infrared beam directly across said vehicle opening to said reflector means which is mounted remotely form said sensor means, whereby said reflector means reflects the infrared beam back to said sensor means when the infrared beam is uninterrupted for sensing if an object moves into a threshold zone adjacent to said vehicle opening, (ii) said platform position monitoring means arranged for determining the position of said platform assembly and comprising a cam wheel which rotates relative to a limit switch and in synchronism with the movement of said platform assembly, whereby the cam wheel changes the condition of the limit switch when said platform assembly is at an unsafe level;

(iii) said control means having a first input coupled to said platform position monitoring means for receiving a platform signal, a second input coupled to said sensor means for receiving a threshold signal, and an output for transmitting an output signal based on the conditions of said platform signal and said threshold signal; and (iv) said warning means coupled to said output of said control means for receiving said output signal form said control means which in turn activates said warning means to indicate when an object moves into said threshold zone while said platform assembly is at said unsafe level;

f. whereby said threshold warning system of said wheelchair lift provides warning when an object moves into said threshold zone while said platform assembly is at said unsafe level.

29. The wheelchair lift in accordance with claim 28 wherein said infrared beam is modulated for the purpose of distinguishing the beam form ambient light.

30. The wheelchair lift in accordance with claim 28 wherein said warning means is an audio warning device.

31. The wheelchair lift in accordance with claim 28 wherein said warning means is a visual warning device.

32. The warning system in accordance with claim 28 wherein said unsafe level is a platform position which is lower than an entry level position at said vehicle opening.

33. The warning system in accordance with claim 28 wherein said threshold zone has a depth of a pre-defined safe distance.

34. The warning system in accordance with claim 33 wherein said pre-defined safe distance is not less than eighteen (18) inches.

* * * * *

US006043741C1

(12) EX PARTE REEXAMINATION CERTIFICATE (9726th)

United States Patent
Whitmarsh

(10) Number: US 6,043,741 C1
(45) Certificate Issued: Jun. 27, 2013

(54) THRESHOLD WARNING SYSTEM FOR WHEELCHAIR LIFTS

(75) Inventor: Sean J. Whitmarsh, Santa Clarita, CA (US)

(73) Assignee: Merrill Lynch Capital, a division of Merrill Lynch Business Financial Services Inc., Chicago, IL (US)

Reexamination Request:
No. 90/009,658, May 17, 2010

Reexamination Certificate for:

| | |
|---|---|
| Patent No.: | **6,043,741** |
| Issued: | **Mar. 28, 2000** |
| Appl. No.: | **09/079,648** |
| Filed: | **May 15, 1998** |

(51) Int. Cl.
*G08B 21/00* (2006.01)

(52) U.S. Cl.
USPC ..... 340/540; 340/522; 340/541; 340/556; 340/573.1; 340/686.1

(58) Field of Classification Search
None
See application file for complete search history.

(56) References Cited

To view the complete listing of prior art documents cited during the proceeding for Reexamination Control Number 90/009,658, please refer to the USPTO's public Patent Application Information Retrieval (PAIR) system under the Display References tab.

*Primary Examiner* — Christopher E Lee

(57) ABSTRACT

A threshold warning system is installed directly on a conventional lift to fully comply with the SAE standard No. J2093. The threshold warning system comprises a sensor device for sensing whether there is an object crossing the boundary of the threshold zone, and a platform position indication device for determining whether the platform is in an unsafe position. The threshold warning system comprises an audible and/or visual warning device for warning a wheelchair user or a passenger when the user or passenger moves into a threshold zone from the vehicle opening while the platform is in an unsafe level for exiting from or boarding into the vehicle.

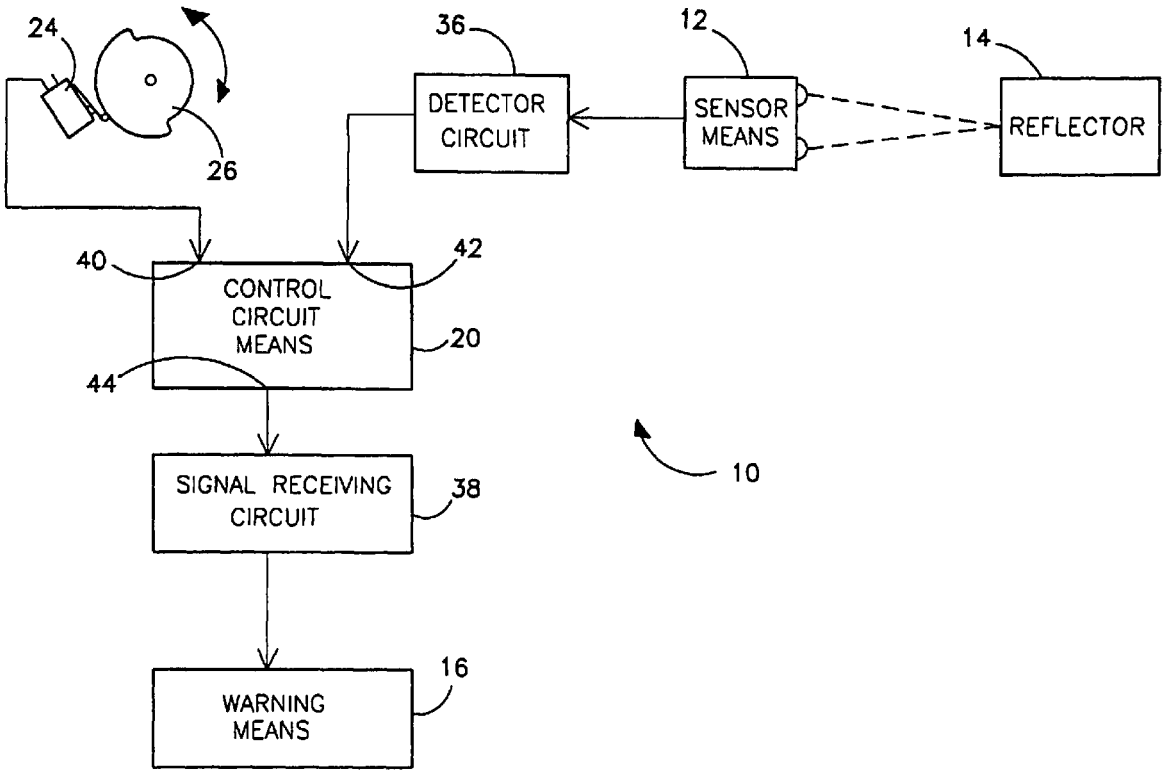

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1, 7-9 and 11-19 are cancelled.

Claims 2-6, 10 and 20-34 were not reexamined.

* * * * *